US007023408B2

(12) United States Patent
Chen et al.

(10) Patent No.: US 7,023,408 B2
(45) Date of Patent: Apr. 4, 2006

(54) PIXEL CIRCUIT FOR ACTIVE MATRIX OLED AND DRIVING METHOD

(75) Inventors: Chien-Ru Chen, Hsinchu (TW); Shang-Li Chen, Hsinchu (TW); Jun-Ren Shih, Hsinchu (TW)

(73) Assignee: Industrial Technology Research Institute, Chutung Hsinchu (TW)

( * ) Notice: Subject to any disclaimer, the term of this patent is extended or adjusted under 35 U.S.C. 154(b) by 432 days.

(21) Appl. No.: 10/636,601

(22) Filed: Aug. 8, 2003

(65) Prior Publication Data

US 2004/0183758 A1 Sep. 23, 2004

(30) Foreign Application Priority Data

Mar. 21, 2003 (TW) ..... 92106421

(51) Int. Cl.
*G09G 3/32* (2006.01)

(52) U.S. Cl. ..... 345/82; 345/76

(58) Field of Classification Search ..... 345/36, 345/39, 45–47, 76, 77, 78, 79, 80, 82–83, 345/204; 313/503–506; 315/169.1–169.4
See application file for complete search history.

(56) References Cited

U.S. PATENT DOCUMENTS

| | | | | |
|---|---|---|---|---|
| 6,753,654 | B1 * | 6/2004 | Koyama | 315/169.1 |
| 6,891,520 | B1 * | 5/2005 | Chen et al. | 345/82 |
| 6,914,390 | B1 * | 7/2005 | Koyama | 315/169.3 |
| 2003/0098829 | A1 * | 5/2003 | Chen et al. | 345/82 |
| 2004/0056604 | A1 * | 3/2004 | Shih et al. | 315/169.2 |
| 2004/0129933 | A1 * | 7/2004 | Nathan et al. | 257/40 |

* cited by examiner

*Primary Examiner*—Vijay Shankar
*Assistant Examiner*—Nitin Patel
(74) *Attorney, Agent, or Firm*—Bacon & Thomas, PLLC

(57) ABSTRACT

A pixel circuit for active matrix OLED and driving method is proposed in this invention, which includes five transistors and one capacitance, it's mainly use a first-transistor connected to a control line to let a second transistor connected to the former scan line off when writing a low voltage in, so to avoid large current generation and IR-drop, finally the illumination will be more uniform than prior art.

10 Claims, 8 Drawing Sheets

PIXEL CIRCUIT FOR ACTIVE MATRIX OLED AND DRIVING METHOD

BACKGROUND OF THE INVENTION

1. Field of the Invention

The present invention relates to a pixel circuit for active matrix OLED and driving method which provide the illumination uniformity.

2. Description of the Related Art

Organic light emitting devices is a new light emitting technology, its principle is a sandwich structure that organic film to place in between two electrode layers. The light need transparent to device, so one of electrodes needs to use ITO electrode. When drive a forward bias to device between anode and cathode, the electron and hole that generated by anode and cathode will empty into light emitting material and then emit light by radiation and re-combine method.

The major application of Organic Light Emitting Devices is display, the pixel circuit is similar with the circuit of TFT LCD, they are all matrix arrays. An illustrated view showing a pixel circuit of Organic Light Emitting Devices of the prior art is shown as FIG. 1. After scan light 12 turn on the transistor 100, data line 10 provides a voltage and stores to capacitance 102. It's equal to voltage of transistor $V_{GS}$, and transistor 101 convert voltage to current and current through transistor 101 by power line 11 and then transmit to Organic Light Emitting Diode. The current formula is $$I = \frac{1}{2}k(V_{GS} - V_t)^2.$$

The problem which pixel circuit of prior art is the threshold voltage of TFT has big variation. It causes big variation of current I, and different current of OLED in pixel circuit. Finally, the uniformity of illumination isn't well.

From FIG. 2 is an illustrated view showing a local pixel circuit layout on display panel of the prior art. If the voltage VDD of signal line 21 is 12V, then maintain wholly white frame need 8V that data line 22 writing a voltage. When the first scan line $S_{N-1}$ scan and turn on, writing 8V to point A. Thus, the voltage on capacitance 23 is 4V and current generated by transistor $M_1$ under $V_{GS}$ transmit to OLED 24, transmitting from transistor $M_1$ to OLED through signal line 21. When the first scan line $S_{N-1}$ cut-off and the second scan line $S_N$ turn on, the data writing 8V to point B and transistor $M_2$ generate current through signal line 21, but point C is even lower than 12V because parasitic resistance of signal line 21 has IR-drop. It causes the voltage of capacitance 25 on pixel circuit $P_2$ is not equal to voltage of capacitance 23 on pixel circuit $P_1$, and the frame from top to bottom generates non-uniformity when writing the same data. This kind of phenomenon which parasitic resistance of signal line 21 to descend the voltage VDD is called IR-drop.

Refer to FIG. 3 is an illustrated view showing a pixel circuit of OLED of the another prior art. This circuit uses four Thin-film Transistors (TFT) 30,31,32,33 and two capacitance 36,37, wherein the value of capacitance for capacitance 36 is C1 and the value of capacitance for capacitance 37 is C2. Four transistors include drive transistor 30 which convert voltage to current and three transistors 31,32,33 which to do turn on or cut-off. Driving has two statement, one is AutoZero statement that using transistor 31,32 short, transistor 33 open and data line 34 transmits a VDD data, transistor 30 forms a connection of diode because transistor 32 short and point A stores the threshold voltage $V_{t1}$ of transistor 30. Another statement is writing statement that transistor 32 cut-off, data line 34 transmit a correct data and using capacitance couple principle, voltage of point A stores the value of $$\Delta V \times \frac{c_1}{c_1 + c_2} + V_{t1},$$

ΔV is the voltage volume of couple. When transistor 33 turns on, the voltage of point A lets transistor 30 generate current, the current formula is $$I = \frac{1}{2}k(V_{GS} - V_t)^2,$$

the $V_t$ in formula will be eliminated. The current has relationship with voltage on data line 34 and no relationship with the threshold voltage $V_t$ of transistor. It can overcome the threshold voltage has variation induced current and illumination also has variation in former prior art. Due to this circuit need four transistors and two capacitance and need two statements, so also need two complex control signals.

Refer to FIG. 4 is an illustrated view showing a pixel circuit 4 of OLED of the another prior art. This pixel circuit 4 uses four Thin-film Transistors (TFT) 41,42,43,44 and one capacitance 45, wherein the function of transistor 41 is a switch, transistor 42 convert voltage to current and provide Organic light emitting diode (OLED) 46, and the function of transistor 43,44 is compensating threshold voltage ($V_t$) of transistor 42. Thus, scan signal SN turn on transistor 41, data line 47 provide a lowest voltage, and then transistor 44 will turn on and decrease voltage of B point to turn on transistor 43, data line 47 provide higher voltage $V_{DATA}$. Due to low voltage of B point will turn on transistor 43, thus, providing the current of OLED 46, the formula is $$Id = k(V_{GS} - V_t),\ k = \frac{1}{2}\mu \cdot C_{OX}\frac{W}{L}. \quad (1)$$

$$V_{G42} = V_B = V_A - V_{t43} \quad (2)$$

$$Id = k(V_{DD} - (V_A - V_{t43}) - V_{t42})^2 \quad (3)$$

In formula (3), $V_{t43}=V_{t42}$ because the difference is close between transistor 42 and transistor 43, and process variation small. It replaces to formula (2) is $Id=k(V_{DD}-V_A)^2$, $V_A=V_{DATA}$, it shows no relationship with current and threshold voltage $V_{th}$ of transistor.

In formula (3), $V_{G42}$ is a voltage of gate of transistor 42; $V_{t43}$ is a threshold voltage of transistor 43; $V_{t42}$ is a threshold voltage of transistor 42; $V_{DD}$ is a voltage transmitted by signal line 48.

From the result of formula mention above, this circuit 4 can overcome threshold voltage variation of transistor on display induced illumination non-uniformity and layout area is smaller. But before writing a real data, it need provide a low voltage and then transistor 42 provide a high current to OLED 46, the illumination of display will brighter first and recover to normal status. It causes shorten the life-time of OLED and worse image quality, and operation complex because it need to provide a low voltage before writing correct data in data driving circuit.

To resolve problems mentioned above that threshold voltage and IR-drop induced illumination non-uniformity of OLED. In this invention propose a pixel circuit for active matrix OLED and driving method and achieve the purpose of the illumination uniformity in display.

SUMMARY OF THE INVENTION

A pixel circuit for active matrix OLED and driving method is proposed in this invention, it use a first-transistor connect to a control line to let a second transistor which connect to the former scan line cut-off when writing a low voltage in, so to avoid large current generation and IR-drop.

To achieve the purpose mentioned above, a pixel circuit for active matrix OLED in this invention includes the first transistor which received control signal output by signal line and then cut-off; the second transistor which received scan signal output by former scan line and provide a low voltage; the third transistor which received scan signal output by corresponding scan line and then turn on it; the fourth transistor which received data voltage output by signal line and convert to current output to organic light emitting diode; the fifth transistor to compensate threshold voltage of the fourth transistor.

According to pixel circuit mentioned above, a circuit driving method for active matrix OLED in this invention includes: Input a control signal to Kth parallel signal and cut-off the first transistor controlled by Kth and (K−1)th control line; Input a scan signal to turn on the second transistor controlled by (K−1)th parallel scan line and writing a low voltage to compensate threshold voltage; Input next scan signal to turn on the third transistor controlled by Kth parallel line and writing data in pixel circuit of Kth parallel line; Finally, to finish the scan control flow of pixel circuit of Kth parallel line.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION OF THE PREFERRED EMBODIMENTS

Figure 1:
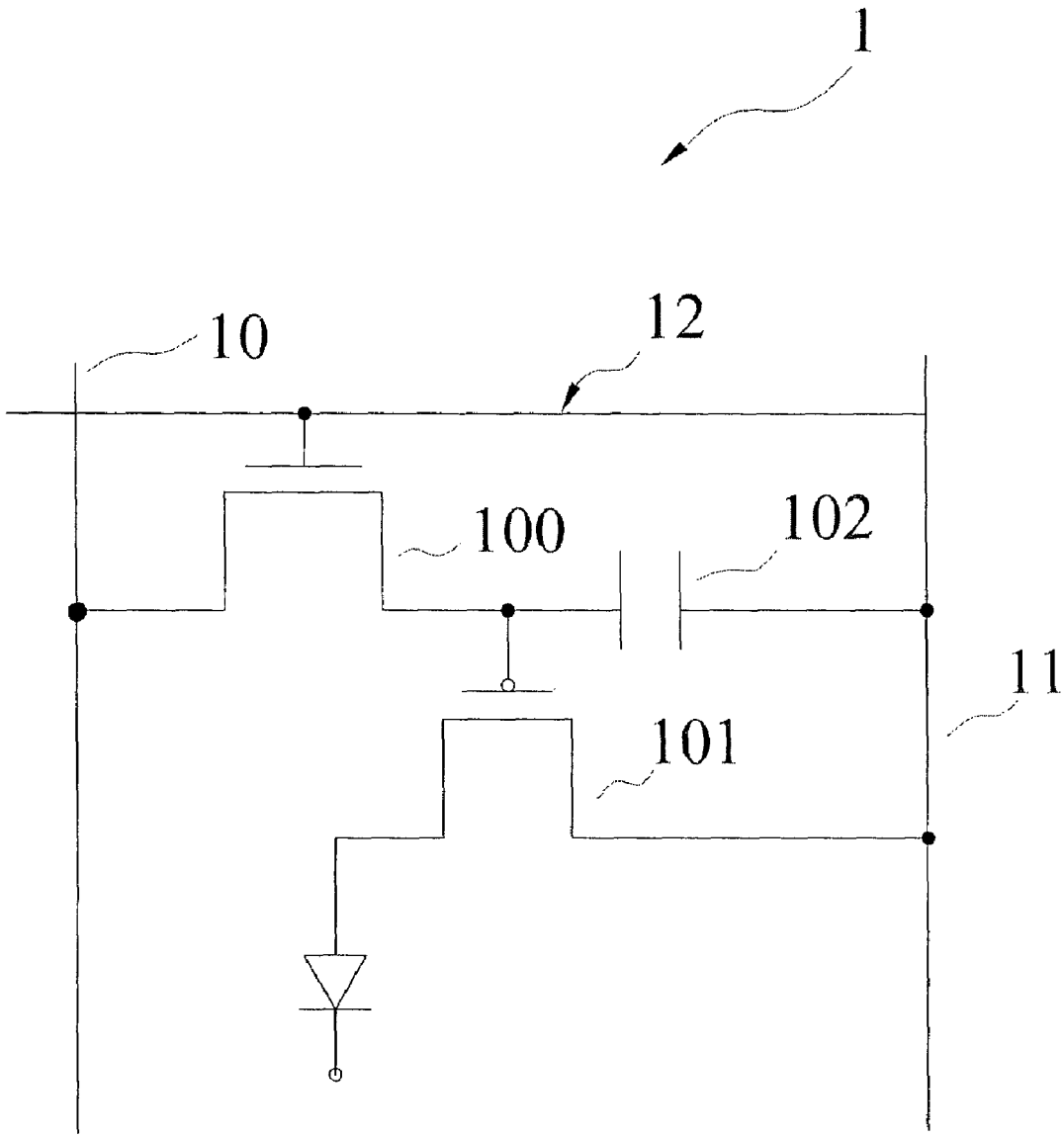
Fig. 1 (Prior Art)
FIG. 1 is an illustrated view showing a pixel circuit of Organic Light Emitting Devices of the prior art.
Figure 2:
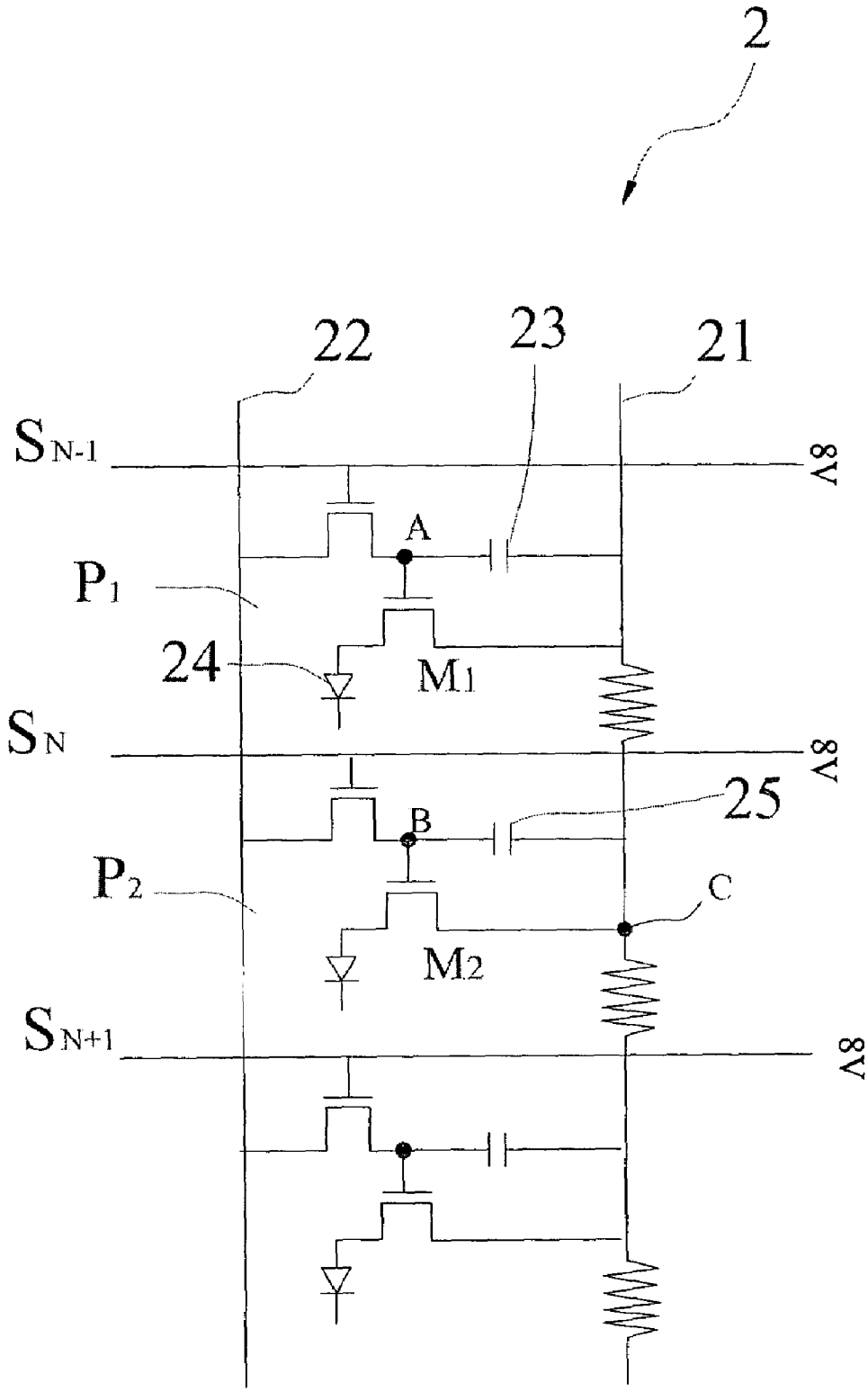
Fig. 2 (Prior Art)
FIG. 2 is an illustrated view showing a local pixel circuit layout on display panel of the prior art.
Figure 3:
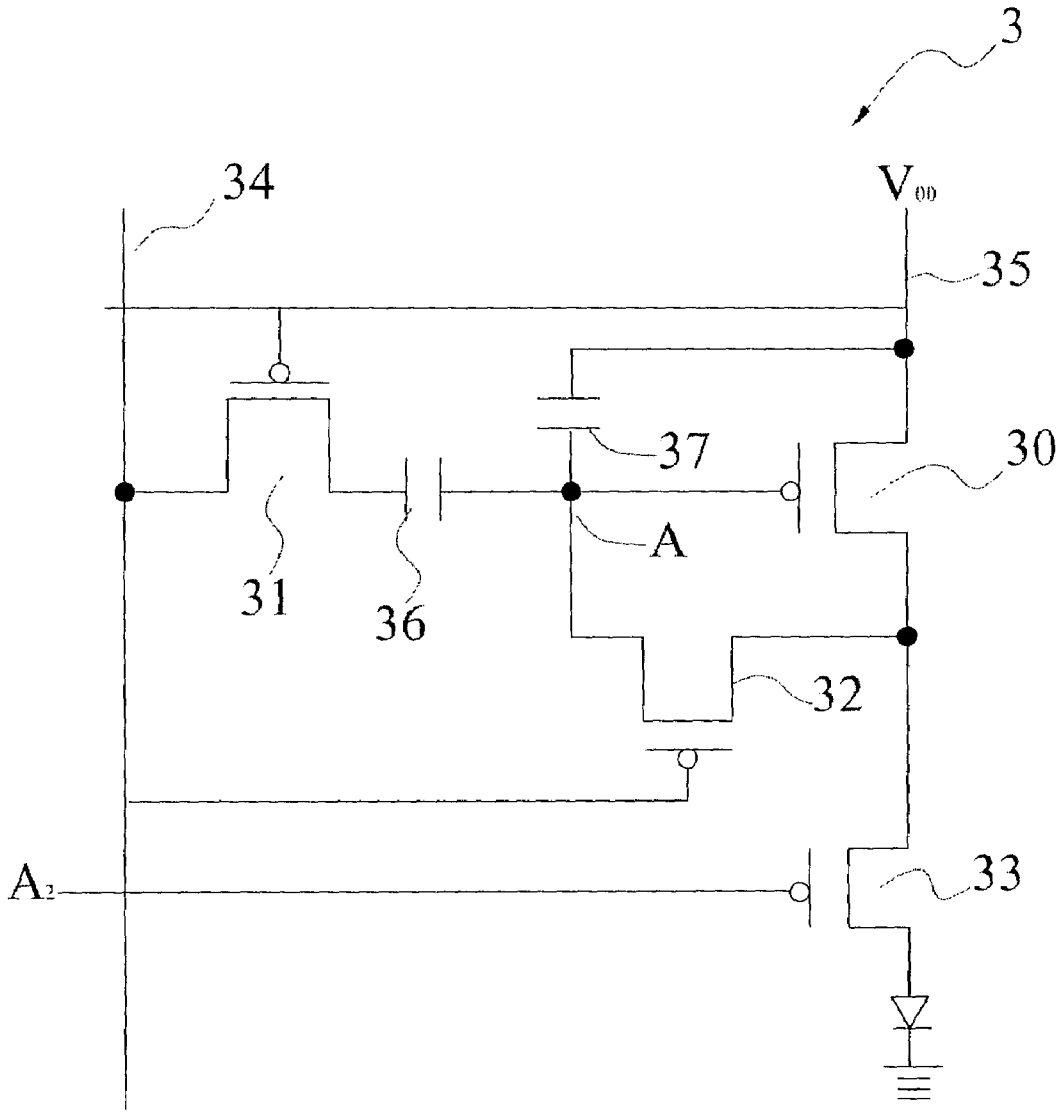
Fig. 3 (Prior Art)
FIG. 3 is an illustrated view showing a pixel circuit of Organic Light Emitting Devices of the another prior art.
Figure 4:
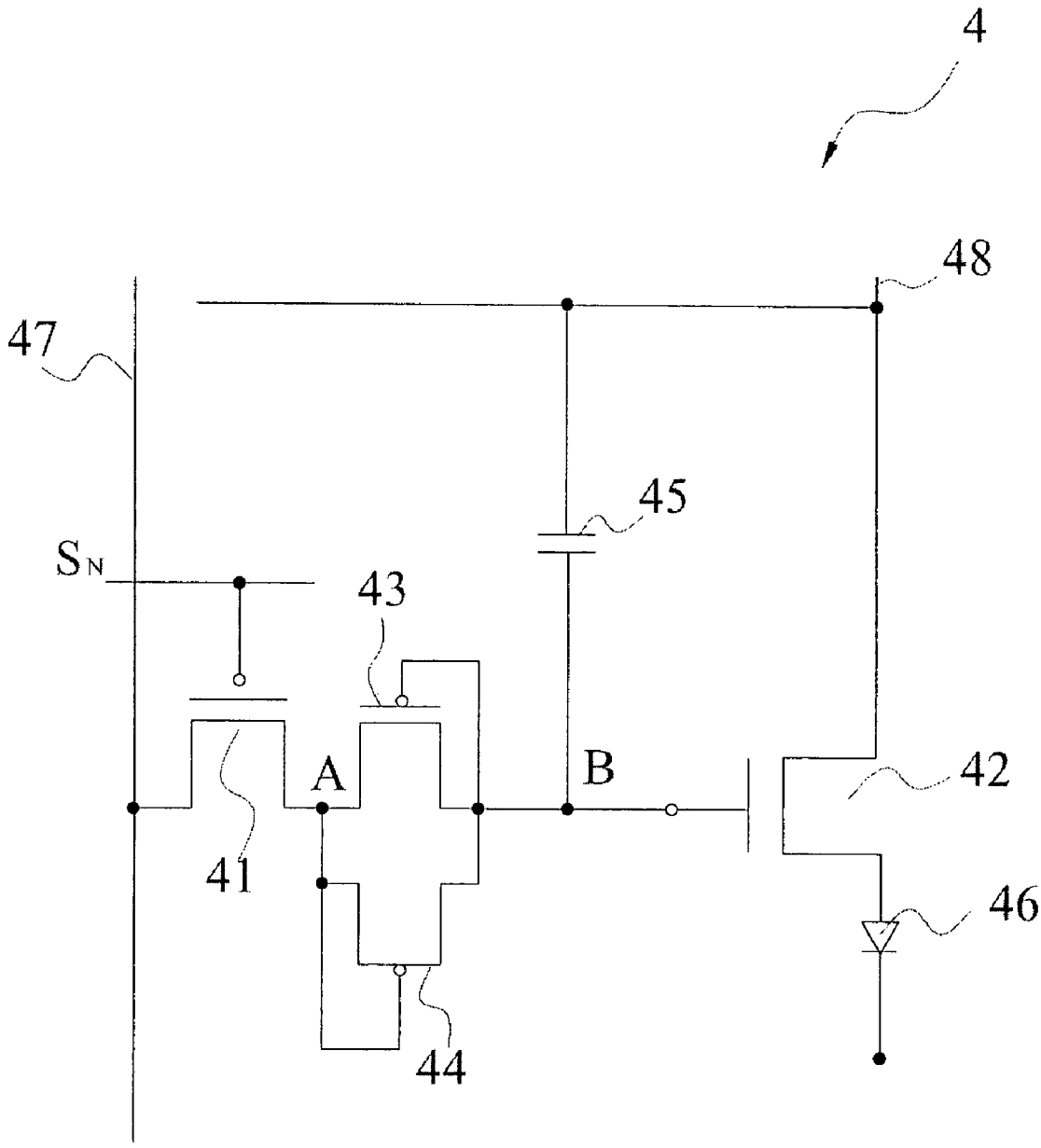
Fig. 4 (Prior Art)
FIG. 4 is an illustrated view showing a pixel circuit of Organic Light Emitting Devices of the another prior art.

Reference will now be made in detail to the preferred embodiments of the present invention, examples of which are illustrated in the accompanying drawings. Wherever possible, the same reference numbers are used in the drawings and the description to refer to the same or like parts.

Figure 5:
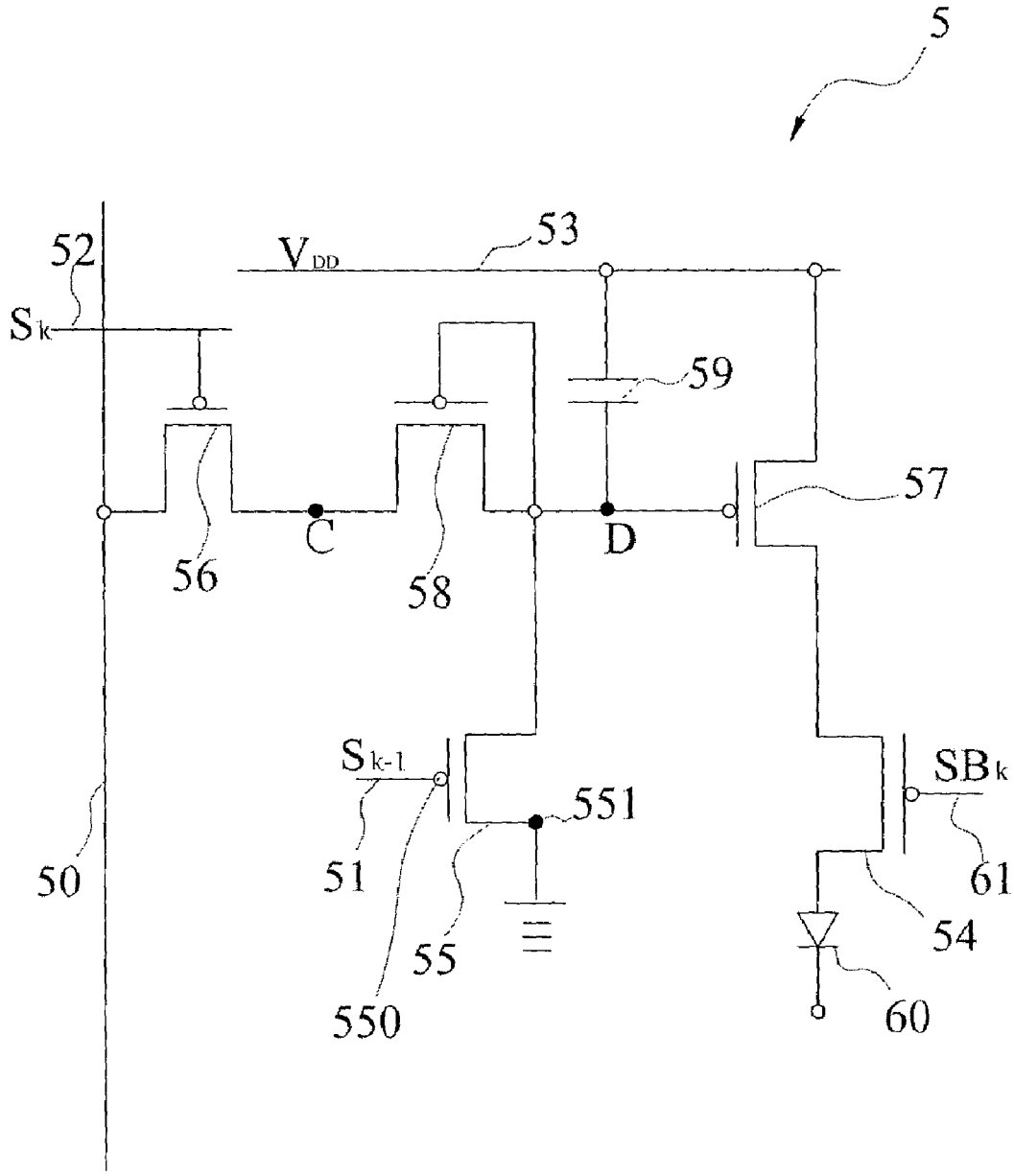
FIG. 5 is an illustrated view showing a pixel circuit in accordance to an embodiment of the present invention.

Refer to FIG. 5 is an illustrated view showing a pixel circuit 5 in accordance to an embodiment of the present invention, wherein includes a data line 50, a former scan line 51, a scan line 52, a signal line 53, the first transistor 54, the second transistor 55, the third transistor 56, the fourth transistor 57, the fifth transistor 58 and a storage capacitance 59.

The function of the first transistor is a switch which received control signal $SB_K$ output by control line 61 to cut-off the first transistor 54; the second transistor 55 which received scan signal $S_{K-1}$ output by former scan line 51 and provide a low voltage to saturate the fifth transistor 58. The gate 550 of the second transistor 55 connect to former (K−1)th scan line 51 and drain 55 connect to a low voltage signal (GND); the third transistor 56 which received scan signal $S_K$ output by Kth scan line 52 and then turn on the third transistor 56 and write a data to D point, that is means store to capacitance; the fourth transistor 57 which received data voltage ($V_{DATA}$) of storage capacitance and convert to current output to organic light emitting diode 60; the fifth transistor 58 which setting between the third 56 and the fourth transistor 57 to compensate threshold voltage of the fourth transistor 57.

Figure 6:
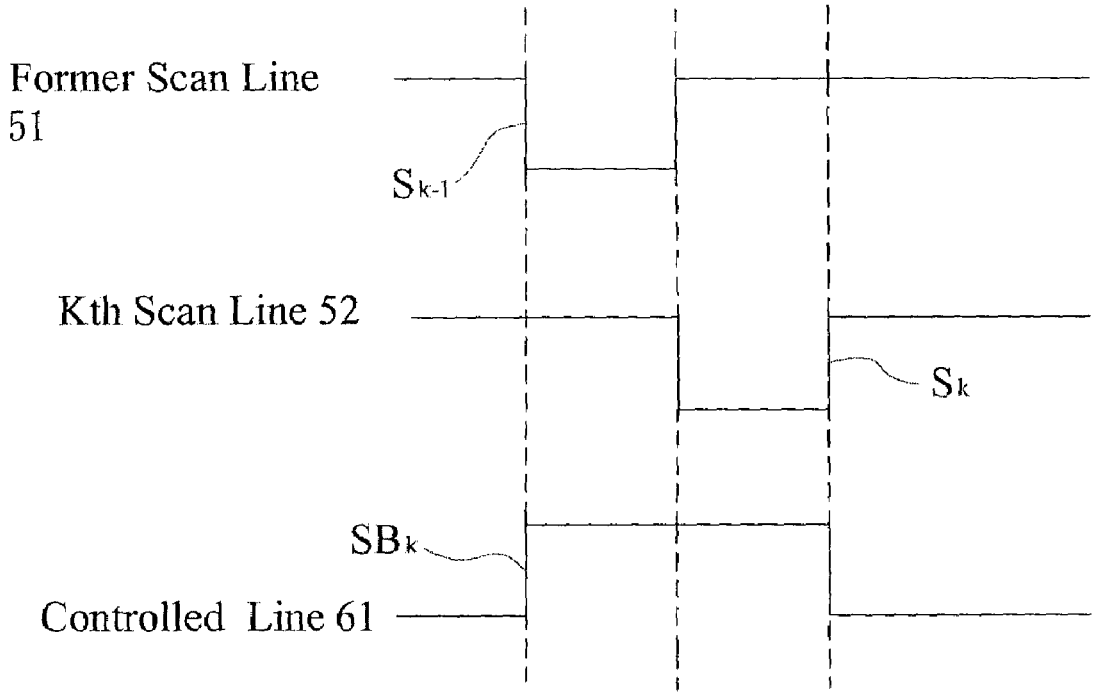
FIG. 6 is an illustrated view showing a wave of control signal in accordance to an embodiment of the present invention.

Actual circuit driving status refers to FIG. 6. The first, control line 61 output a control signal $SB_K$ to the first transistor 54 and cut-off it, and former scan line 51 is also output a scan signal to the second transistor 55. This signal $S_{K-1}$ is a low voltage, so reduce the voltage of D point to turn on the fifth transistor 58 and form diode connection method. The difference of voltage of point C and point D is a threshold voltage ($V_{t58}$) and then this Kth scan line 52 output control signal $S_K$ to turn on the third transistor 56, a data line 50 written voltage $V_{DATA}$ to the third transistor 56 and the fourth transistor 57 store to storage capacitance 59. At this moment, the first transistor 54 is still cut-off, and after the third transistor 56 cut-off by control signal $S_K$, the first transistor 54 will turn on and generate current. The voltage of point C is $V_C=V_{DATA}$, the gate voltage of the fourth voltage 57 ($V_{G57}$) is equal to the voltage of point C ($V_C$) minus the threshold voltage on the fifth transistor 58 ($V_{t58}$); the formula is $$V_{G57}=V_D=V_C-V_{t58}$$

the current formula:

$$Id = k(V_{GS} - V_t),\ k = \frac{1}{2}\mu \cdot C_{OX}\frac{W}{L}; \tag{1}$$

$$Id=k(V_{DD}-(V_C-V_{t58})-V_{t57})^2 \tag{2};$$

Due to the fourth and fifth transistor (57,58) is very close in process, so their threshold voltage is equivalent.

In formula (2)

$$V_{t58}=V_{t57} \tag{3}$$

so $$Id=k(V_{DD}-V_C)^2, V_C=V_{DATA} \quad (4)$$

It shows no relationship between current and threshold voltage of transistor.

Wherein $V_{t57}$ of formula (2) and (3) is threshold voltage of the fourth transistor 57, $V_{DD}$ of formula (2) is a voltage that transfer by signal line 53.

The function of the first transistor 54 and the third transistor 56 is a switch, and the second transistor 55 provides a low voltage. The fourth transistor 57 converts voltage to current for OLED 60. The fifth transistor 58 compensates the threshold voltage $V_{th}$ of the fourth transistor 57.

Figure 7:
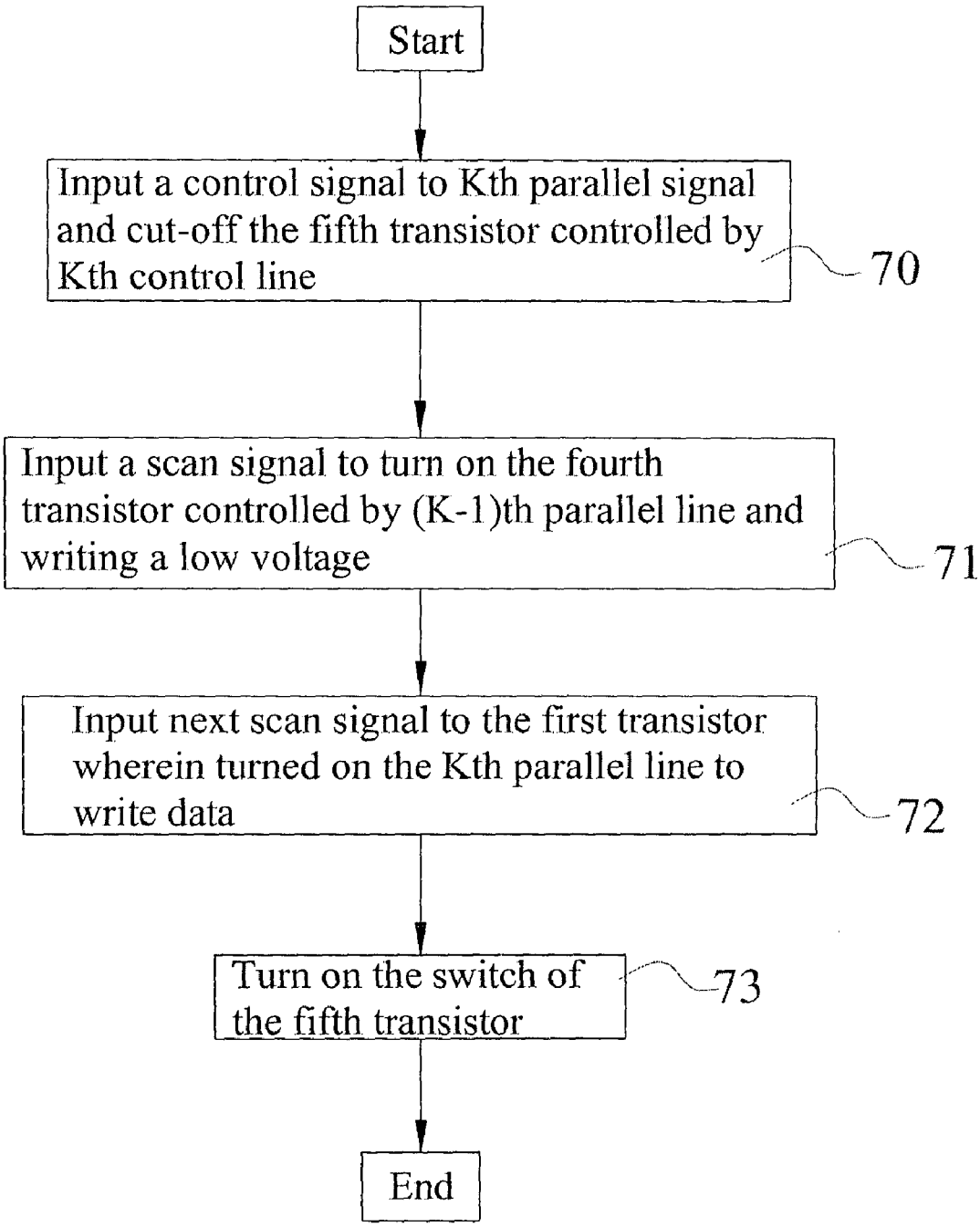
FIG. 7 is an illustrated view showing a scan control flow of pixel circuit in accordance to another embodiment of the present invention.

The scan control flow of pixel circuit is shown as FIG. 7. At first, to progress step 70, input a control signal to Kth parallel signal and cut-off the fifth transistor controlled by Kth control line, this time span of control line is two periods of parallel scan; to progress step 71, input a scan signal to turn on the fourth transistor controlled by (K−1)th parallel line and writing a low voltage in wherein the time span of turn on scan signal is a parallel scan line period; Next, to progress step 72, input next scan signal to turn on the third transistor controlled by Kth parallel line and writing data in pixel circuit of Kth parallel line, this time span of turn on scan signal is a parallel scan line period; Final, to progress step 73, turn on the switch of the fifth transistor that is controlled by Kth control line and then finish the scan control flow of pixel circuit of Kth parallel line.

Figure 8:
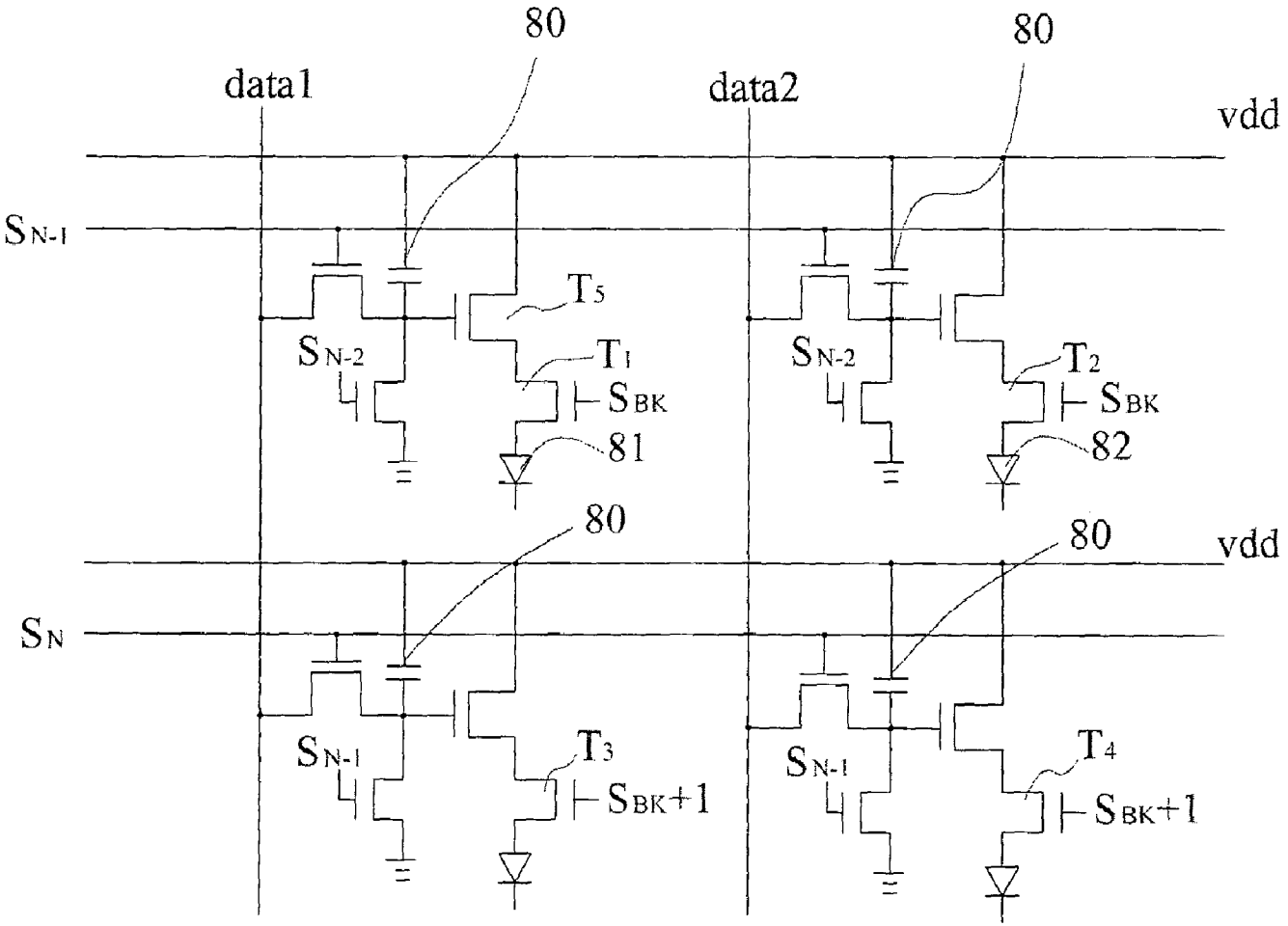
FIG. 8 is an illustrated view showing a circuit layout which can resolve IR-drop of signal line in accordance to another embodiment of the present invention.

Refer to FIG. 8 is an illustrated view showing a circuit layout which can resolve IR-drop of signal line in accordance to another embodiment of the present invention, wherein the layout method of signal line is parallel layout with scan line. A driving method mentioned above is when scan line $S_{N-2}$ turn on, transistor T1 and T2 that controlled by control line $S_{BK}$ is cut-off, so signal line $V_{dd}$ has no current; when scan line $S_{N-1}$ turn on and writing voltage to storage capacitance, transistor T1 and T2 are also turn off, and transistor T3 and T4 turn off because control line $S_{BK+1}$ is work. When scan line $S_{N-1}$ finish working, and data line writing the same voltage to storage capacitance 80 of each pixel, then transistor T1 and T2 turn on, the $(S_{N-1})$th OLED 81,82 are illuminative. Although signal line has current and IR drop, this IR drop generated suddenly will decrease voltage of storage capacitance because of coupling. For driving transistor T5, the value $V_{gs}$ is the same with value that writing voltage but not yet generates current, so no IR-drop. It causes the different effect at storage voltage of each pixel.

The detail explanation in this invention is mention above, due to add a first transistor in pixel circuit to be a switch to avoid generating high current on the fourth transistor, contrast non-uniformity and increase OLED life time when writing a low voltage before driving in pixel circuit.

Due to the first transistor is cut-off when scan line turn on the second and the third transistor and writing voltage data, and signal line has no current and no IR-drop, so it can resolve the illumination non-uniformity induced by IR-drop.

What is claimed is:

1. A pixel circuit for active matrix OLED applied to matrix circuit of a display, wherein matrix circuit includes: a plurality of parallel scan lines, and signal line and control line that parallel with scan line, wherein pixel circuit comprising:

a first transistor received control signal output by signal line and then cut-off;

a second transistor received scan signal output by former scan line and provide a low voltage;

a third transistor received scan signal output by corresponding scan line and then turn on it;

a fourth transistor received data voltage output by signal line and convert to current output to organic light emitting diode; and a fifth transistor compensating threshold voltage of the fourth transistor.

2. The pixel circuit for active matrix OLED in accordance with claim 1, wherein the gate connects with drain of the second transistor and the electricity connect to former scan line.

3. The pixel circuit for active matrix OLED in accordance with claim 1, wherein the gate of second transistor connects to former scan line and the drain connect to a low-voltage signal.

4. The pixel circuit for active matrix OLED in accordance with claim 1, wherein the first to fifth transistors are PMOS.

5. The pixel circuit for active matrix OLED in accordance with claim 1, wherein the first to fifth transistors are NMOS.

6. The pixel circuit for active matrix OLED in accordance with claim 1, wherein the signal line is power line and the layout method is parallel scan signal.

7. A pixel circuit for active matrix OLED applied to matrix circuit of a display, wherein matrix circuit includes: a plurality of parallel scan lines, and signal line and control line that parallel with scan line, comprising the steps of:

inputting a control signal to Kth parallel signal and cut-off the first transistor controlled by Kth control line;

inputting a scan signal to turn on the second transistor controlled by (K−1)th parallel line and writing a low voltage in;

inputting next scan signal to turn on the third transistor controlled by Kth parallel line and writing data in pixel circuit of Kth parallel line; and wherein the fourth transistor switch off that is controlled by input voltage and finish the scan control flow of pixel circuit of Kth parallel line.

8. The circuit driving method for active matrix OLED in accordance with claim 7, wherein the time of switch off the first transistor is two periods of parallel scan line.

9. The circuit driving method for active matrix OLED in accordance with claim 7, wherein the time span of scan signal of turn on the second transistor is a parallel scan period.

10. The circuit driving method for active matrix OLED in accordance with claim 7, wherein the time span of next scan signal is a parallel scan period.

* * * * *